US007073935B2

(12) United States Patent
Liem

(10) Patent No.: US 7,073,935 B2
(45) Date of Patent: Jul. 11, 2006

(54) METHOD AND APPARATUS FOR HANDLING RESIDUAL CONTENTS OF A CONTAINER FOR A LIQUID OR SEMI-LIQUID

(76) Inventor: Todd Liem, 2500 Bayport Blvd., Seabrook, TX (US) 77586

( * ) Notice: Subject to any disclaimer, the term of this patent is extended or adjusted under 35 U.S.C. 154(b) by 81 days.

(21) Appl. No.: 10/636,825

(22) Filed: Aug. 7, 2003

(65) Prior Publication Data

US 2005/0030833 A1 Feb. 10, 2005

(51) Int. Cl.
*A47L 17/06* (2006.01)
*B44D 3/08* (2006.01)

(52) U.S. Cl. ..... 366/129; 15/236.06; 15/236.07; 15/236.08; 15/236.09

(58) Field of Classification Search ..... 366/129, 366/343, 605; 416/70 R, 71; 15/236.01, 15/236.03, 236.05, 236.06, 236.07, 236.08, 15/236.09; 30/169, 353, 355; D32/46, 49
See application file for complete search history.

(56) References Cited

U.S. PATENT DOCUMENTS 1,040,138 A * 10/1912 Buck ..... 452/103
1,498,509 A * 6/1924 Arnold ..... 416/71
2,234,242 A * 3/1941 Gilbert ..... 30/169
2,555,735 A * 6/1951 Estabrooks ..... 30/355
2,608,706 A * 9/1952 Wakefield ..... 15/236.09
2,685,131 A * 8/1954 Seeberger ..... 30/355
2,777,676 A * 1/1957 Carter ..... 366/129
2,860,858 A * 11/1958 Kurs ..... 366/129
4,188,952 A * 2/1980 Loschilov et al. ..... 606/79
4,350,445 A * 9/1982 Olsson ..... 366/343
4,355,432 A 10/1982 Storm
4,553,279 A * 11/1985 Gassew et al. ..... 7/105
4,627,128 A 12/1986 Shea
4,674,186 A 6/1987 Galiano
D318,989 S * 8/1991 Risner ..... D7/688
5,491,868 A 2/1996 Baggenstos
5,494,352 A * 2/1996 L'Estrange, Jr. ..... 366/343
5,875,515 A 3/1999 Dallas

* cited by examiner

*Primary Examiner*—David Sorkin
(74) *Attorney, Agent, or Firm*—Fulbright & Jaworski, LLP

(57) ABSTRACT

An apparatus is provided for handling the contents of a container for a liquid or semi-liquid, including the residual contents. The subject container is one that has a bottom surface, sidewalls that extend upwardly from the bottom surface and form a bottom corner therewith, and a top opening defined by an inwardly protruding rim. The apparatus includes an elongated handle adapted for stirring the contents of the container and characterized by a lateral width and a longitudinal centerline that extends through the handle as well as the entire length of the apparatus. The apparatus also has a contacting portion interconnected with the handle. The contacting portion includes a generally vertical contact edge for engaging the sidewalls of the container and residual contents thereon, a second generally vertical edge in spaced apart relation with the generally vertical contact edge, and a generally horizontal contact edge for scraping the bottom surface of the container and residual contents thereon. The contacting portion is further characterized in that a first lateral distance from the longitudinal centerline to the generally vertical contact edge is substantially greater than a second lateral distance between the longitudinal centerline and the second generally vertical edge. Accordingly, a lateral width of the contacting portion is substantially greater than the handle width and a lateral offset portion having the generally vertical contact edge extends in a lateral direction along the first lateral distance. The lateral offset portion is particularly suited for providing access under the rim of the container.

7 Claims, 3 Drawing Sheets

METHOD AND APPARATUS FOR HANDLING RESIDUAL CONTENTS OF A CONTAINER FOR A LIQUID OR SEMI-LIQUID

BACKGROUND OF THE INVENTION

The present invention relates generally to a method and apparatus for handling the contents, including the residual contents, of a container for a liquid or semi-liquid. More particularly, the invention is directed to a manual tool or utensil capable of handling residual contents, including solidified or partially solidified material attached to the walls and corners of the container. The inventive method and apparatus are particularly suited for handling the residual contents in containers such as pails, buckets, tubs, and the like, of various sizes and shapes.

BRIEF SUMMARY OF THE INVENTION

In one aspect of the invention, an apparatus is provided for handling the contents of a container for a liquid or semi-liquid (e.g., relatively very viscous material), including the residual contents (e.g., solidified or partially-solidified materials such as drying paint). The subject container is one that has a bottom surface, sidewalls that extend upwardly from the bottom surface and form a bottom corner therewith, and a top opening defined by an inwardly protruding rim. The apparatus includes an elongated handle adapted for stirring the contents of the container and characterized by a lateral width and a longitudinal centerline that extends through the handle as well as through the entire length of the apparatus. The apparatus also has a contacting portion interconnected with the handle. The contacting portion includes a generally vertical contact edge for engaging (e.g., scraping) the sidewalls of the container and residual contents thereon, a second generally vertical edge in spaced apart relation with the generally vertical scraper edge, and a generally horizontal contact edge for engaging the bottom surface of the container and residual contents thereon. The contacting portion is further characterized in that a first lateral distance from the longitudinal centerline to the generally vertical contact edge is substantially greater than a second lateral distance between the longitudinal centerline and the second generally vertical edge. Accordingly, a lateral width of the contacting portion is substantially greater (e.g., at least about 1.2 times greater) than the handle width and a lateral offset portion having the generally vertical scraper edge extends in a lateral direction along the first lateral distance. The lateral offset portion is particularly suited for providing access under the rim of the container.

In another aspect of the invention, an apparatus is provided for handling the contents of a container for a liquid or semi-liquid, including the residual contents. Again, the apparatus includes an elongated handle that is configured for stirring or shifting (e.g., removing) the contents of the container. The handle has a lateral width and a longitudinal centerline that extends through the entire length of the apparatus. A contacting portion for engaging the contents of the container is further provided in interconnection with the handle. The contacting portion includes a generally vertical contact edge for engaging the sidewalls of the container and residual contents thereon, a generally horizontal contact edge for engaging the bottom surface of the container and residual contents thereon, and an arcuate edge positioned at one end of the generally horizontal edge for engaging residual contents on the bottom surface and sidewalls of the container.

Preferably, the arcuate edge is a serrated, arcuate edge adapted to cutting residual contents adhered to the sidewalls or bottom surface of the container. More preferably, each of the arcuate edge, the generally horizontal contact edge, and the generally vertical contact edge is a dually beveled edge. Furthermore, in a preferred embodiment, the generally horizontal contact edge and the generally vertical contact edge meet to define a corner adapted to engage the sidewall, bottom surface, and the corner between the sidewall and bottom surface.

In yet another aspect of the present invention, a container contents handling apparatus is provided having at least three functioning sections or portions. The apparatus has an elongated handle that is configured for manual gripping and for stirring or shifting the contents of the container. The handle has a lateral width and a longitudinal centerline that extends through the length of the apparatus. The handle may also have a pair of grip notches configured to accommodate the manual grip of a user and an aperture for suspending the apparatus.

The inventive apparatus further includes a contacting portion interconnected with the handle. The contacting portion includes a generally vertical contact edge for engaging the sidewalls of the container and residual contents thereon, a second generally vertical edge in spaced apart relation with the generally vertical contact edge, and a generally horizontal contact edge for engaging the bottom surface of the container and residual contents thereon. A third functioning portion is an extended measuring portion having a lateral width and extending between the handle and the contacting portion. The measuring portion includes a graduated scale for measuring the contents of the container. The contacting portion has a lateral width that is substantially greater (e.g., 1.2 to 1.75 times greater) than each of the handle width and the lateral width of the measuring portion. Accordingly, a lateral offset portion having the generally vertical contact edge extends in a first lateral direction from the longitudinal centerline and is adapted to provide access under the rim of the container.

Preferably, the apparatus has a longitudinal side margin spaced apart from the longitudinal centerline that is substantially straight. This side margin provides or includes side edges of the handle, measuring portion, and contacting portion, and is on the side of the longitudinal centerline opposite of the side or edge on which the lateral offset portion is located.

As used herein, the term "handling" shall mean a variety of functional interactions between the inventive apparatus and the container and/or the contents of the container. This includes the use of the inventive apparatus to stir, mix, remove, shift, and measure the contents of the container. This also includes the use of the inventive apparatus to engage the walls of the container and/or residual contents adhered thereto. For example, the inventive apparatus may be used to break, cut, remove, beat, scrape, penetrate, or peel the residual contents, or to clean or free the walls, corners, and other surfaces of the container of residual contents. Moreover, the term residual contents, as used herein, refers to an amount of the contents substantially less than what is ordinarily considered a sufficient supply. For example, a paint can may have residual contents remaining in the form of dry or drying paint on the sidewalls, bottom surface, or corners of the can.

DETAILED DESCRIPTION OF THE DRAWINGS

Figure 1:
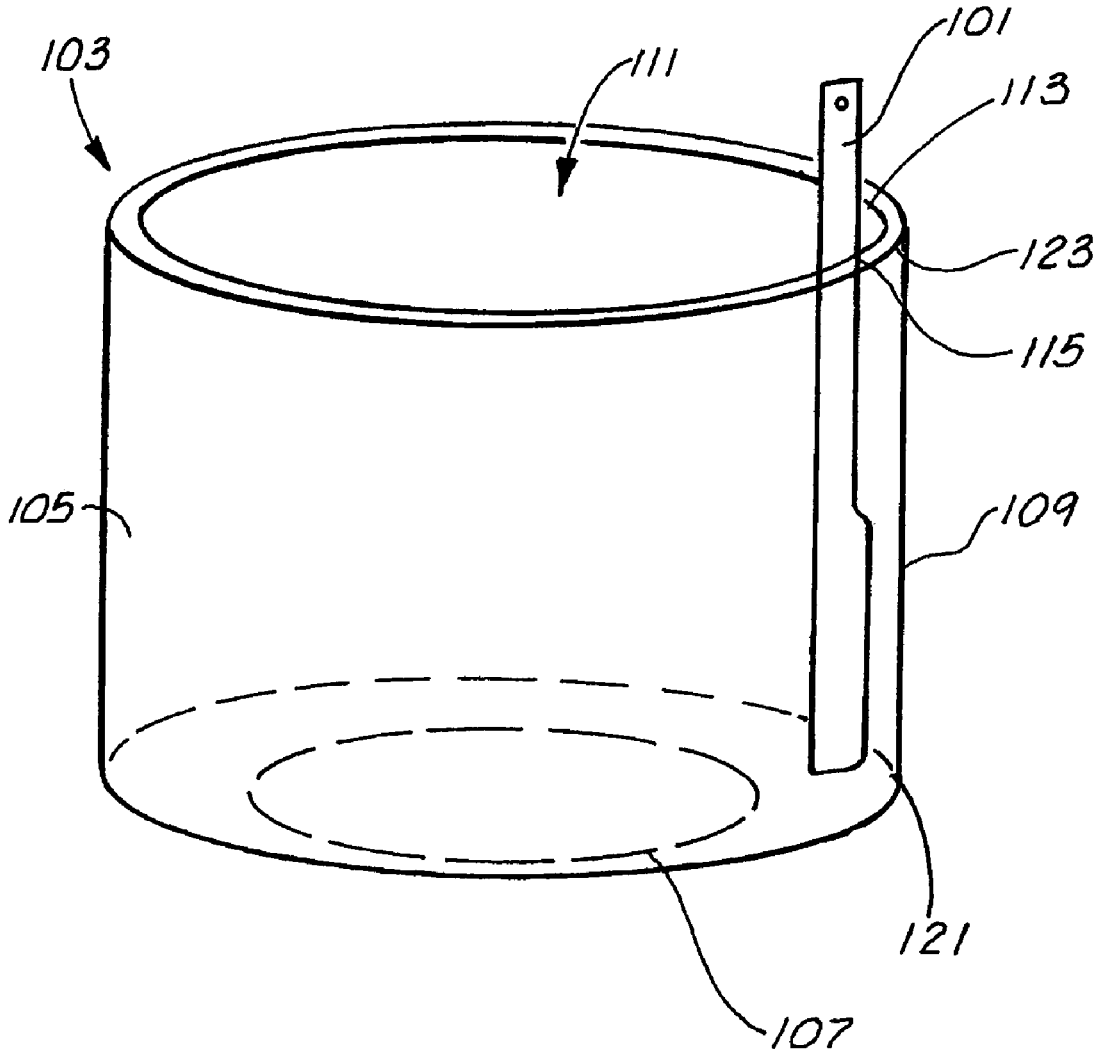
FIG. 1 is a side view of one embodiment of an apparatus for handling the contents of a container according to the present invention, depicted in position within the container.
Figure 2:
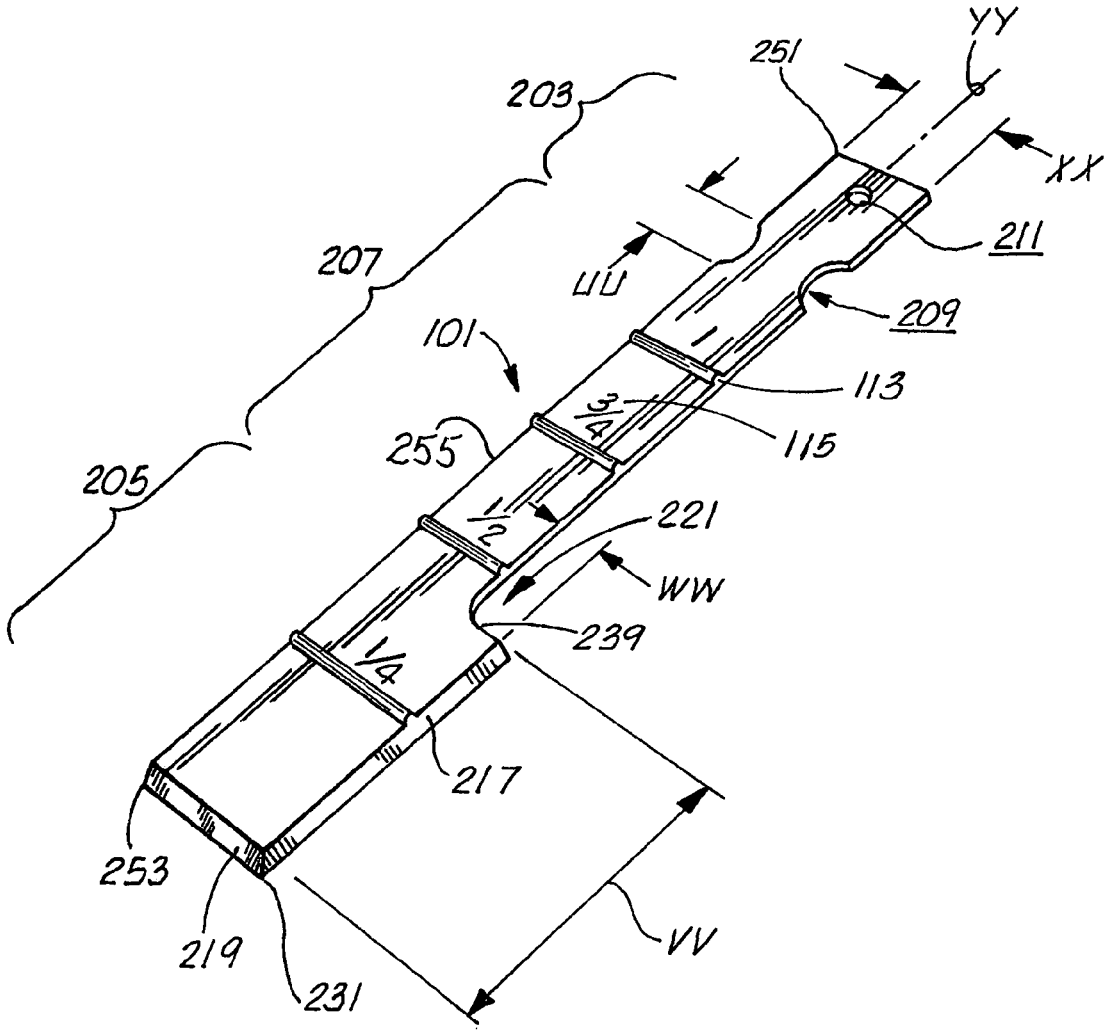
FIG. 2 is a perspective view of the handling apparatus according to the present invention.
Figure 3:
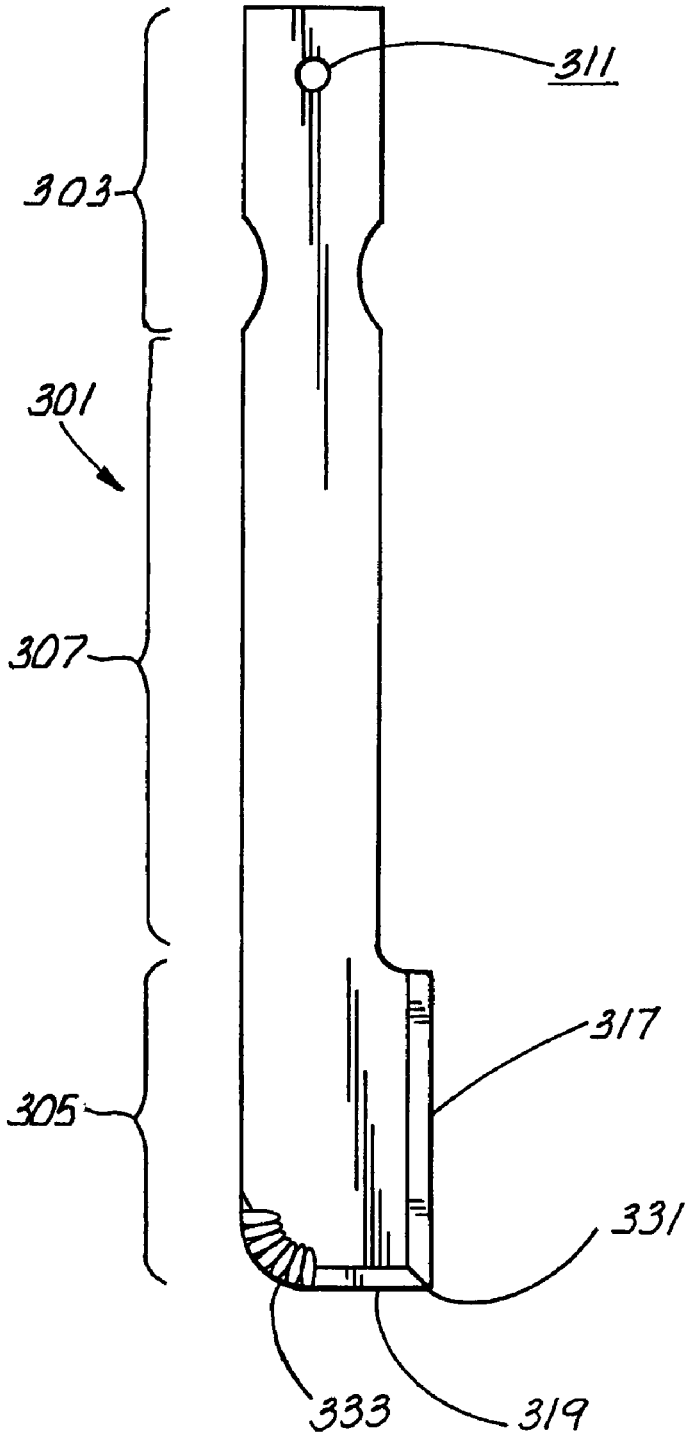
FIG. 3 is a plan view of an alternative embodiment of the handling apparatus according to the invention.

Each of FIGS. 1–3 depict, in accordance with the present invention, an exemplary apparatus for handling the contents, including residual contents, of a container of a liquid or semi-liquid. FIG. 2 depicts a first embodiment of the inventive handling apparatus. FIG. 3 depicts an alternative embodiment of the inventive handling apparatus.

Referring to FIG. 1, a handling apparatus or utensil 101 according to the invention is particularly suited for use with a container 103 for a liquid or semi-liquid (e.g., relatively very viscous liquid). In FIG. 1, the utensil 101 is depicted in use with a cylindrical can 103 containing paint or other viscous material. The cylindrical paint can 103 has a bottom surface or floor 107, all around side walls 109 extending upwardly from a bottom corner 121 about the floor 107 and a top, circular opening 111. The top opening 111 is defined by an inwardly extending rim or lip 113 onto which a lid (not shown) is typically secured. The projection of the rim 113 into the top opening 111 creates an underside lateral offset 115 and top inside corner 123 within the can 103. With prior art methods and apparatus, the rim 113 provides an obstruction that can make for difficult access to residual contents on the lateral offset 115, in the top corner 123, or the sidewalls 109 immediately below the top corner 123 (i.e., anywhere under the rim 113)

In a preferred embodiment, the inventive utensil 101 is structurally suited for breaking, scraping, cutting, beating, removing, penetrating, peeling, or otherwise handling the residual, dry or drying, paint contents 105 on the floor 107 and side walls 109 of the container 103 as well as residual contents adhering to the underside lateral offset 115, and in or around the bottom corner 121 and the top corner 123. The preferred utensil 101 may also be used to mix, stir, shift, move, or remove the contents of the can 103 (when the can 103 contains at least a measurable amount). Further, the preferred utensil 101 may be used to measure the amount of paint or other contents inside the container 103.

It should be noted that the inventive utensil 101 and a method utilizing the utensil 101 is equally adapted for use with other container configurations, including rectangular or other geometrically shaped cans or containers. For example, the inventive utensil 101 and method may be used to handle the contents of a pail, bucket, or can of varying configurations, etc. Moreover, the inventive utensil 101 and method of using the same also has applications in the handling of various liquids or semi-liquids, including paint thinners, adhesives, and the like. Accordingly, the present invention is not intended to be limited to the utensil structures and handling methods specifically described and illustrated herein. For purposes of description, the following discussion will be directed to a pair of exemplary utensils and the use of the utensils within a cylindrical paint can.

FIG. 2 depicts a first embodiment of the inventive utensil 101. In one aspect of the invention, the inventive utensil 101 may be considered as having three distinct functional sections or portions: a handle portion 203, a residual contents handling or contacting portion 205, and an extended measuring portion 207 located therebetween. Preferably, the utensil 101 will come in the form of a generally flat, elongated stick. The utensil 101 may be made of wood, plastic, or metal, as dictated by the particular handling application. For purposes of description, the utensil 101 is referred to as having a top or proximal end 251, a distal end 253, a first side edge or margin 255, and a second side edge or margin 257. Further, the generally flat utensil 101 is characterized by a longitudinal centerline YY extending centrally through the handle 203, as well as through the measuring portion 207, and contacting portion 205. As shown in FIG. 1, the first side margin 255 extends in a substantially straight line from the proximal end 251 to the distal end 253. The second side margin 257 does not, on the other hand, extend along a substantially straight line, but advantageously deviates outward to create a lateral offset or enlarged portion as will be discussed below.

The preferred utensil 101 has an elongated, generally flat ergonomic handle 203. The handle 203 has a lateral width XX that extends between the side edges 255, 257 and is selected to suit the grip of a typical user. Preferably, the handle 203 includes a pair of arcuately-shaped gripping notches or recesses 209 on both sides of the handle 203. The grip notches 209 are sized and positioned to accommodate or suit the manual grip, particularly the fingers, of the user. In the embodiment of FIG. 2, the grip notches 209 preferably has a radial length VV of about 1".

Typically, the measuring portion 207 is an extension of the handle 203 and has a lateral width equal or slightly greater (e.g., tapered) than the handle width XX. The measuring portion 207 is, of course, sized so as to accommodate the type and size of containers and contents typically used with the utensil 101. As shown in FIG. 2, the measuring portion 207 provides a graduated scale for indicating the depth of the contents (or volume of the contents). The graduated scale is, at least in this embodiment, provided by specifically located protrusions 113 on one side of the utensil 101. The protrusions 113 provide quarter graduations and include markings 115 indicating as such.

As mentioned above, the length of measuring portion 207 will be dictated by the depth of the typical container for use with the utensil 101. Further, the width of the extension 207 will be somewhat governed by its length plus the length of the handle portion 203 to ensure both flexibility and structural integrity to the utensil 101.

In yet another aspect of the invention, the utensil 101 is provided with a contacting portion 205 at the distal portion of the utensil 101. The contacting portion 205 has a lateral width ZZ and longitudinal length VV. Preferably, the lateral width XX is greater (e.g., at least 1.2 times greater) than the width of the measuring portion 207 and handle width XX. This disparity creates the lateral offset 221 and the offset shoulder 239 on one side of the utensil 101. As shown in FIG. 2, a width WW of the offset shoulder 239 is equal to the difference between the lateral width of the contacting portion ZZ and the lateral width XX. The contacting portion 207 further includes a generally vertical side edge 215 (coincident with side edge 255), a generally vertical, beveled side edge or scraper edge 217 and a generally horizontal bottom beveled edge 219. The side edge 217 and the bottom edge 219 meet to define a sharp corner edge (generally a 90° corner) or corner 231. Preferably, the side edge 217 and bottom edge 219 are dual-beveled (beveled on both sides) to better engage and penetrate dry, residual contents.

With the contacting portion 205, the inventive utensil 101 provides several unique features. The greater area of the contacting portion 205 provides capacity to handle a larger volume of contents (e.g., for stirring, shifting, or removing contents). This is accomplished without enlarging the other dimensions of the utensil 101 such as the widths XX of the handle 203 or measuring portion 207, and thus, without sacrificing the flexibility and maneuverability of the utensil 101.

Furthermore, the side edge 217 of the contacting portion 205 is well adapted to handling (in particular, scraping, cutting, peeling, penetrating, and removing) the residual contents that adhere or otherwise remain on the side walls of the container 203. In a rectangular container, the side edge 217 can also readily and aggressively handle residual contents that remain on the vertical corners. On the other hand, the bottom edge 219 is well configured and positioned for handling the residual contents on the floor 107 of the container 103, and to a large extent, residual contents on the sidewalls 109. In this embodiment, the bottom edge 219 also provides a corner edge or point 231 for reaching residual contents along the bottom corner 121. The sharp, hard point of the corner edge 231 is also effective at cutting or otherwise penetrating dry, hard residual contents adhered to the various surfaces of the container 103.

As yet another aspect of the invention, the lateral offset 221 provides for ready access underneath the rim 113 of the can 103 (or other container). The lateral width ZZ, or more particularly offset shoulder width WW is typically designed to exceed the width of the lateral offset 115. In this way, the utensil 101 can be used to access the hard-to-get-to area under the rim 113. This allows the side edge 217, as well as the offset shoulder 239, to reach and then scrape, cut, or otherwise remove residual contents remaining in this area.

Thus, in one aspect of the invention, a preferred embodiment of the utensil 101 provides multiple functions, including measuring the contents of the container, handling the contents of the container (e.g., stirring, shifting, or removing) and handling (e.g., cutting, scraping, etc.) the residual contents of the container.

In various preferred embodiments wherein the length of the apparatus is about 1-0", the handle width XX is about 1¼" while the lateral width ZZ of the contacting portion is about 1¾". The dimensions make for a lateral offset shoulder 239 having a width WW of about ½". Such a width WW corresponds to the rims of many cylindrical paint cans. The length VV of the contacting portion 205 is about 3". This provides a container 101 with a contacting portion 205 in this exemplary embodiment having an improved capacity to handle relatively large volumes of contents in the container 103, and a handle 203 providing both flexibility and strength.

FIG. 3 depicts an alternative embodiment of the invention, wherein like reference numerals are sued to indicate like elements of the utensil. The inventive utensil 301 according to this embodiment also has an ergonomic handle 303, a residual handling or contacting portion 305, and an extended portion 307 positioned therebetween. The ergonomic handle 303, as with the embodiment of FIG. 2, includes ergonomic gripping notches 309 and aperture 311 for suspending the apparatus. Although not shown in FIG. 3, the measuring portion 307 may also include a graduated scale.

Now turning to the details of the contacting portion 307, the utensil 101 preferably includes a generally vertical, dual-beveled side edge 317 and a generally horizontal, dual-beveled bottom edge 319. Both of these edges 317, 319 are particularly adapted for handling the residual contents remaining on the floor 107 or side walls 109, respectively of the container 103. In a further aspect of the invention, the contacting portion 305 is also provided with a rounded or arcuate, serrated back edge 333. The serrated edge 333 enhances the surface contact made by the utensil 301, while the serrated feature of the edge 333 enhances the ability of the utensil 301 to penetrate and cut hard, dry residual contents. In the embodiment of FIG. 3, the utensil 301 also includes a corner edge 331 (similar to corner 231 in FIG. 2). Accordingly, the serrated arcuate edge 333 is preferably provided at one end of the bottom edge 319 and the sharp, corner edge 331 is provided on the opposite end adjacent the side edge 317.

Various embodiments of the present invention have been described herein. It should be understood by those of ordinary skill in the relevant art, however, that the above-described embodiments, such as a utensil having the serrated edge or other feature described above, are set forth merely by way of example and should not be interpreted as limiting the scope of the invention, which is defined by the appended claims. Other alternative embodiments, variations and modifications of the foregoing embodiments that embrace various aspects of the present invention will also be understood upon a reading of the detailed description in light of the prior art. For instance, it will be understood that application of the various edges or other structural features of the utensil may be applied in differently configured utensils for handling the residual contents of a container. These and other features, structural or otherwise, may be combined with features of other embodiments than those in the a prior art, while many other features may be omitted or replaced.

What is claimed is:

1. An apparatus for handling the contents of a container for a liquid or semi-liquid, including the residual contents, wherein the container has a bottom surface, sidewalls that extend upwardly from the bottom surface and form a bottom corner therewith, and a top opening defined by an inwardly protruding rim, said apparatus comprising:

an elongated handle configured for stirring the contents of the container, said handle having a lateral width and a longitudinal centerline that extends through the length of said apparatus; and a contacting portion interconnected with said handle, said contacting portion including a generally vertical contact edge for engaging the sidewalls of the container and residual contents thereon, a second generally vertical edge in spaced apart relation with said generally vertical contact edge, and a linear generally horizontal contact edge for engaging the bottom surface of the container and residual contents thereon, wherein a first lateral distance from said longitudinal centerline to said generally vertical contact edge is substantially greater than a second lateral distance between said longitudinal centerline and said second generally vertical edge and wherein the length of the linear generally horizontal contact edge of said contacting portion is substantially greater than said handle width, such that a lateral offset portion having said generally vertical contact edge extends in a lateral direction, said lateral offset portion being configured for accessing under the rim of the container, wherein said contacting portion further includes a serrated, arcuate edge adapted for penetrating residual contents adhered to the sidewalls of bottom surface of the container, said arcuate edge being positioned at one end of said generally horizontal contact edge.

2. An apparatus for handling the contents of a container for a liquid or semi-liquid, including the residual contents, wherein the container has a bottom surface, sidewalls that extend upwardly from the bottom surface and form a bottom corner therewith, and a top opening defined by an inwardly protruding rim, said apparatus comprising:

an elongated handle configured for stirring the contents of the container, said having a lateral width and a longitudinal centerline that extends through the length of said apparatus; and a contacting portion interconnected with said handle, said contacting portion including a generally vertical contact edge for engaging the sidewalls of the container and residual contents thereon, a second generally vertical edge in spaced apart relation with said generally vertical contact edge, and a linear generally horizontal contact edge for engaging the bottom surface of the container and residual contents thereon, wherein a first lateral distance from said longitudinal centerline to said generally vertical contact edge is substantially greater than a second lateral distance between said longitudinal centerline and said second generally vertical edge and wherein a lateral width of said contacting portion is substantially greater than said handle width, such that a lateral offset portion having said generally vertical contact edge extends in a lateral direction, said lateral offset portion being configured for accessing under the rim of the container, wherein each of said generally horizontal contact edge and said generally vertical contact edge is a dually beveled edge, and wherein the length of the linear generally horizontal contact edge is substantially greater than the handle width.

3. The apparatuses of claims 1 or 2, wherein said handle portion includes one or more grip notches configured to accommodate the manual grip of a user.

4. The apparatus of claim 1, wherein each of said generally horizontal contact edge, said arcuate edge, and said generally vertical contact edge is a dually beveled edge.

5. An apparatus for handling the contents of a container for a liquid or semi-liquid, including the residual contents, wherein the container has a bottom surface, sidewalls that extend upwardly from the bottom surface and form a bottom corner therewith, and a top opening defined by an inwardly protruding rim, said apparatus comprising:

an elongated handle configured for manual gripping and for stirring the contents of the container, said handle having a lateral width and a longitudinal centerline that extends through the length of said apparatus;

a contacting portion interconnected with said handle, said contacting portion including a generally vertical contact edge for engaging the sidewalls of the container and residual contents thereon, a second generally vertical edge in spaced apart relation with said generally vertical contact edge, and a generally horizontal contact edge for engaging the bottom surface of the container and residual contents thereon; and an extended measuring portion having a lateral width and extending between said handle and said contacting portion, said measuring portion including a graduated scale for measuring the contents of the container;

and wherein said contacting portion has a lateral width that is substantially greater than each of said handle width and said lateral width of said measuring portion such that a lateral offset portion having said generally vertical edge extends in a first lateral direction from said longitudinal centerline and is adapted to provide access under the rim of the container;

and wherein said contacting portion further includes a serrated, arcuate edge adapted for penetrated solidified and partially-solidified residual contents adhered to the sidewalls or bottom surface of the container, said arcuate edge being positioned at one end of said generally horizontal contact edge.

6. The apparatus of claim 5, wherein each of said generally vertical contact edge, generally horizontal contact edge, and said arcuate edge is a dual beveled edge.

7. The apparatus of claims 5 or 6, wherein said handle portion includes one or more accurate grip notches configured to accommodate the manual grip of a user.

* * * * *